US006887318B2

(12) United States Patent
Bashark

(10) Patent No.: US 6,887,318 B2
(45) Date of Patent: May 3, 2005

(54) ADAPTIVE FILL FOR DISHWASHERS

(75) Inventor: Larry T. Bashark, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 10/616,425

(22) Filed: Jul. 9, 2003

(65) Prior Publication Data

US 2005/0005952 A1 Jan. 13, 2005

(51) Int. Cl.[7] ..... B08B 7/04

(52) U.S. Cl. ..... 134/18; 134/42; 134/57 D; 134/56 D; 134/58 D; 134/113; 134/186; 68/208

(58) Field of Search ..... 134/18, 42, 57 D, 134/56 D, 58 D, 113, 186; 68/208

(56) References Cited

U.S. PATENT DOCUMENTS 4,271,861 A * 6/1981 Crawford ..... 137/387
4,481,786 A 11/1984 Bashark ..... 62/160
5,129,411 A * 7/1992 Lagerstrand ..... 134/56 D
5,284,523 A * 2/1994 Badami et al. ..... 134/18
5,319,304 A 6/1994 Whipple, III ..... 324/107
5,330,580 A 7/1994 Whipple, III et al. ..... 134/18
5,577,399 A 11/1996 Whipple, III et al. ..... 68/12.02
5,722,263 A * 3/1998 Tassotti ..... 68/12.02
6,454,872 B1 9/2002 Miller et al. ..... 134/10

* cited by examiner

*Primary Examiner*—Sharidan Carrillo
(74) *Attorney, Agent, or Firm*—Clifton G. Green; Robert O. Rice; John F. Colligan

(57) ABSTRACT

The present invention provides an adaptive fill control for controlling the amount of liquid added in one or more liquid fill periods in a dishwasher cycle. The amount of liquid added in a liquid fill cycle is adjusted by activating the dishwasher drain pump while continuing to operate the dishwasher circulation pump. The accumulated time from the start of the drain pump operation until the circulation pump experiences a liquid starvation episode is compared to a predetermined optimum time period for the circulation pump to experience liquid starvation. The sign and difference between to accumulated time period and optimum time period is used to adjust the amount liquid added in the next liquid fill period. A number of sensors for detecting a circulation pump liquid starvation episode are disclosed.

27 Claims, 4 Drawing Sheets

ADAPTIVE FILL FOR DISHWASHERS

FIELD OF THE INVENTION

The present invention relates to dishwasher having an adaptive fill control for controlling the amount of liquid added in successive fill sub-cycles that is adaptively adjusted based on operating conditions.

BACKGROUND OF THE INVENTION

Automatic dishwashers for household use have a number of sub-cycles comprising liquid fill, wash or rinse spray and drain. There may be a number of such sub-cycles in each machine cycle which can include RINSE-ONLY to HEAVY-WASH. Typically a flow control washer is included in the fill valve so that a selected number of liters of liquid are added to the dishwasher in a timed fill sub-cycle. However, because of variation in fill valves, water pressure, pump performance, AC line voltage, dishwasher installation and others, more than an optimum amount of liquid for circulation pump operation is typically present in each sub-cycle to provide sufficient liquid under worst case conditions. Fill sub-cycles that add excess liquid waste hot water, dilute detergent concentration and reduce the number of liquid passes through the filter or soil separator.

SUMMARY OF THE INVENTION

One embodiment of the present invention is a method for adjusting the amount of liquid added to a dishwasher in one or more liquid fill periods in a dishwasher cycle. The method comprises the steps of activating the dishwasher drain pump to drain liquid from the dishwasher while continuing to operate the dishwasher circulation pump prior to the end of at least one liquid circulation period; accumulating the time from the start of the drain pump operation until the circulation pump experiences a liquid starvation episode; comparing the accumulated time period with a predetermined optimum time period for the circulation pump to experience liquid starvation; using the difference between the accumulated time period and the predetermined optimum time period to adjust the amount of liquid added in the next liquid fill period; and adding the adjusted amount of liquid during the next liquid fill period.

Another embodiment of the invention is a method for adjusting the amount of liquid added to a dishwasher in one or more liquid fill periods in one or more dishwasher cycles each including a plurality of liquid fill periods, a plurality of liquid circulation periods and a plurality of liquid drain periods operated by a controller. The method comprises the steps of activating the dishwasher drain pump to drain liquid from the dishwasher while continuing to operate the dishwasher circulation pump near the end of at least one liquid circulation period; monitoring operation of the circulation pump to accumulate a circulation pump starvation period beginning with activation of the drain pump and ending when the circulation pump experiences a liquid starvation episode; comparing the circulation pump starvation period with a predetermined optimum time period for the circulation pump to experience liquid starvation to decrease or increase the amount of liquid added in the previous liquid fill period stored in the controller depending on whether the circulation pump starvation period is longer or shorter than the predetermined optimum time period; deactivating the circulation pump after the circulation pump experiences a liquid starvation episode and continuing to operate the drain pump to complete draining of the liquid at the end of said liquid circulation period; storing the adjusted amount of liquid in the controller for the next liquid fill period replacing the previous amount of liquid; and adding the adjusted amount of liquid in the next liquid fill period of the dishwasher.

DESCRIPTION OF THE INVENTION

A dishwasher according to the invention can be provided with an adaptive fill control for controlling the amount of liquid added in successive fill sub-cycles that is adaptively adjusted based on operating conditions. The adaptive fill control can be arranged to iteratively adjust the amount of liquid added in successive fill sub-cycles to the point where a fill sub-cycle will add just enough liquid to the dishwasher to supply liquid to the circulation pump during liquid circulation sub-cycles to provide sufficient liquid for sustained circulation pump operation without any noisy pump starvation episodes and with just enough extra liquid to achieve maximum circulation pump spray force. The amount of liquid added in fill sub-cycles can be adjusted by comparing the time for a circulation pump liquid starvation episode to occur following activation of the drain pump with a predetermined optimum time and adjusting the next fill sub-cycle accordingly. The time for a liquid starvation episode to occur can be determined by activating the drain pump to remove liquid from the dishwasher while continuing to operate the dishwasher circulation pump near the end of a liquid circulation (wash or rinse) sub-cycle. The adaptive fill control accumulates the time from the start of the drain pump operation until the circulation pump experiences a liquid starvation episode. The accumulated time period can be compared with a predetermined optimum time period for the circulation pump to experience liquid starvation. The sign and difference between the accumulated time period and the optimum time period can be used to increase or decrease the next liquid fill period from a base of the most recent previous liquid fill period.

Figure 1:
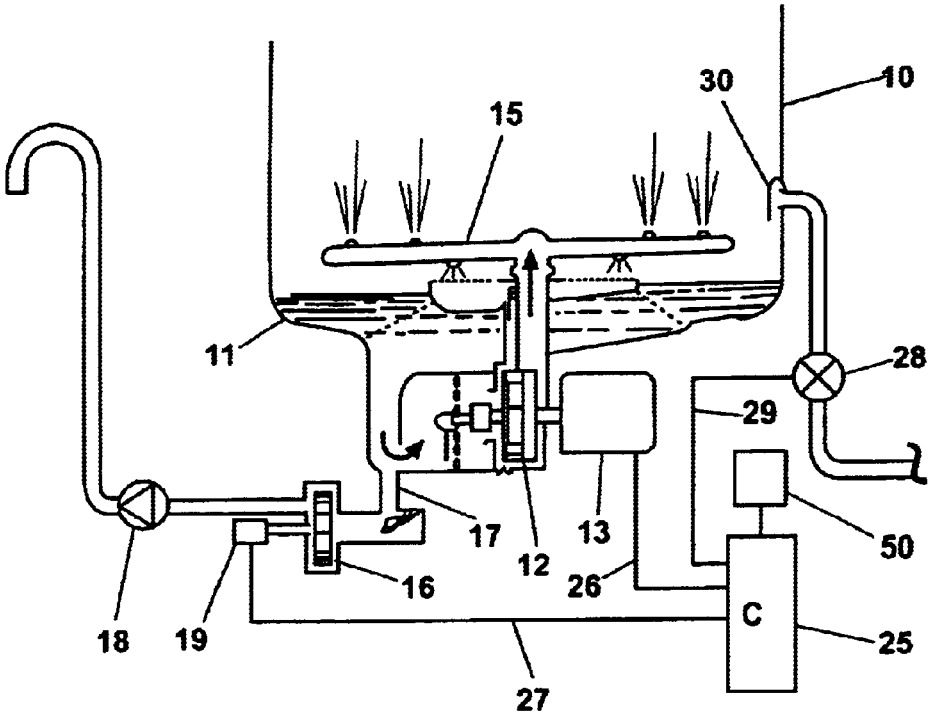
FIG. 1 is a partial schematic of dishwasher having a separate circulation pump and motor and drain pump and motor and having an adaptive fill control according to the invention.

Turning to FIG. 1, a dishwasher arranged to operate according to the invention can be seen in partial schematic form. A dishwasher can have a tub 10, a sump 11 and a circulation pump 12. A motor 13 can drive circulation pump 12. A filter 14 can be provided for separating food particles and the like from the liquid being circulated in tub 10. A spray arm 15 can be provided for spraying wash liquid in tub 10 over dishes carried in one or more dishracks, not shown. While one spray arm is shown in FIG. 1, those skilled in the art will recognize that two or more spray arms can be provided as is well known in the art. A drain pump 16 can be provided to pump liquid from tub 10 during drain sub-cycles drawing liquid through drain line 17 from sump 11 and discharging liquid through check valve 18 to the household drain lines, not shown. A drain pump motor 19 can drive drain pump 16. The circulation pump 12 can be a circulation pump such as disclosed in U.S. Pat. No. 6,454,872, assigned to the assignee of this application, and incorporated herein by reference. Those skilled in the art will recognize that other circulation pump and filter configurations can be employed with the adaptive fill control according to the invention.

The adaptive fill control according to the invention can be incorporated in a controller 25 that can include a microprocessor, not shown. Controller 25 can be arranged to control the circulation pump motor 13 by line 26, drain pump motor 19 by line 27, and a fill valve 28 by line 29. Fill valve 28 can discharge liquid into tub 10 through inlet 30 in the sidewall of tub 10. A sensor circuit, generally indicated at 50, can be provided to provide signals from a sensor monitoring an operating parameter of circulation pump 12 to controller 25 indicative of circulation pump 12 performance including when circulation pump 12 experiences a liquid starvation episode. Those skilled in the art will understand that a sensor circuit can be arranged to provide a suitable signal to controller 25 indicative of a liquid starvation episode. Embodiments of sensors and sensor circuits 50 for providing signals to controller 25 can be seen in to FIG. 3 through FIG. 8 described below.

Figure 2:
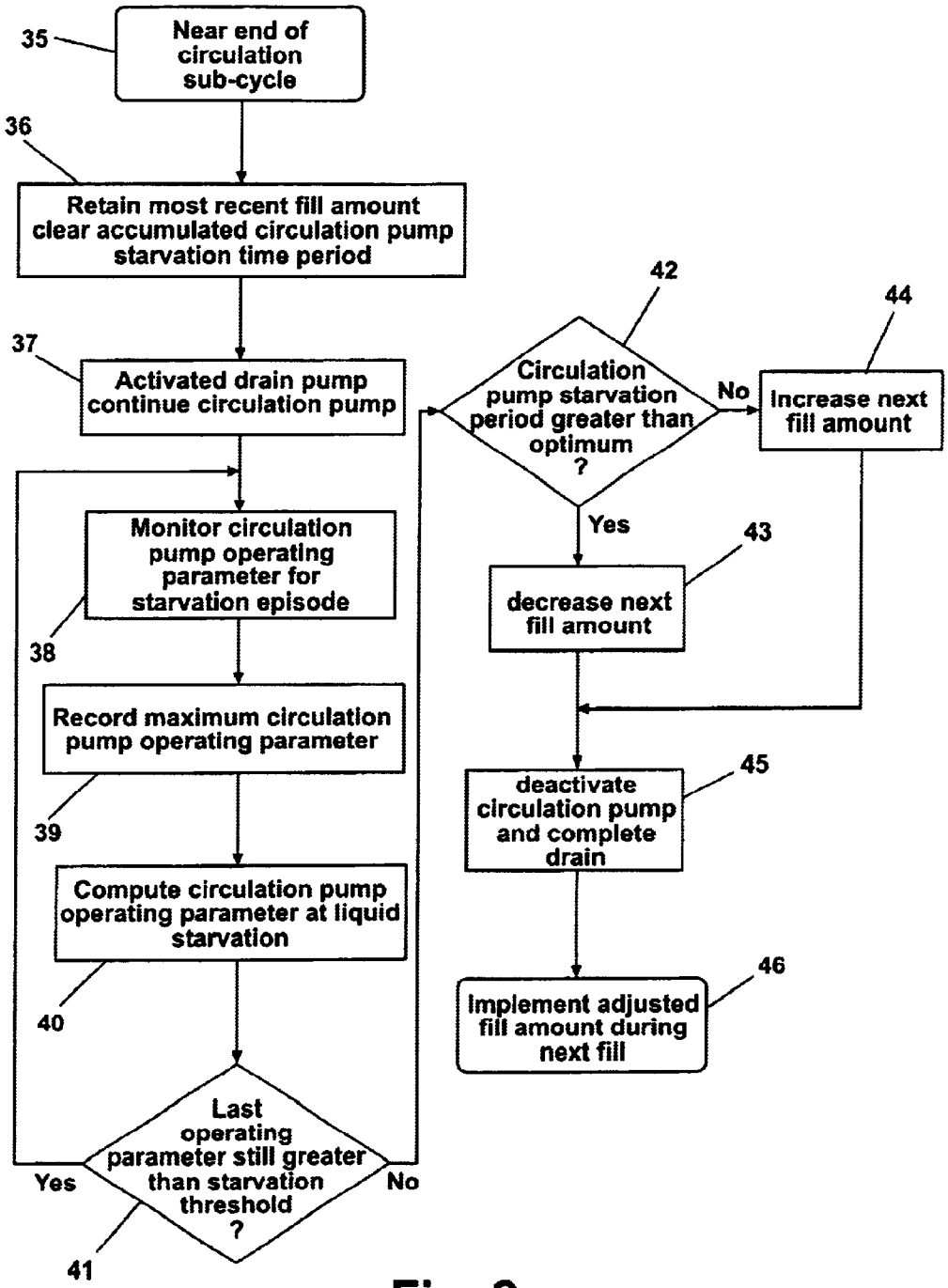
FIG. 2 is a flow chart illustrating a method of adaptively adjusting the amount of liquid added to a dishwasher according to the invention.

Referring to FIG. 2, a method of adaptively adjusting the amount of liquid added to a dishwasher can be seen in the form of a flow chart. The method can begin near the end of a circulation sub-cycle, step 35. In step 36 controller 25 can retain the most recent previous liquid fill amount in an adaptive fill memory, not shown, and clear the most recent accumulated circulation pump starvation time period. Next, in step 37, controller 25 can activate drain pump motor 19 while continuing to operate circulation pump motor 13 to continue spraying liquid in tub 10 in a wash or rinse sub-cycle. Next, in step 38, controller 25 can monitor an operating parameter of circulation pump 12 by monitoring the output of sensor circuit 50 for a liquid starvation episode. For example, sensor circuit 50 can monitor an operating parameter each half cycle of the AC supply, or 120 times per second. Next, in step 39, controller 25 can monitor the output of sensor circuit 50 and record the maximum circulation pump operating parameter as circulation pump 12 continues to operate. Next, in step 40, controller 25 can compute the sensed operating parameter at liquid starvation and, in step 41, compare the last sensed operating parameter with the computed liquid starvation threshold. If the sensed operating parameter is still greater than the computed starvation threshold the controller repeats steps 38 to 41 until the sensed operating parameter is less than the computed liquid starvation threshold. If the sensed operating parameter is less than the computed liquid starvation threshold, step 42 can occur. In step 42 controller 25 can compare the accumulated time from activation of drain pump motor 19 until step 41 produces a "no" result with an optimum period of time for the circulation pump to experience liquid starvation. If the accumulated time to experience a liquid starvation episode is greater than the optimum period of time step 43 occurs and the amount of liquid added in the next fill sub-cycle is decreased from the most recent pervious fill amount. If the accumulated time to experience a liquid starvation episode is less than the optimum period of time step 44 occurs and the amount of liquid added in the next fill sub-cycle is increased from the most recent pervious fill amount. After a liquid starvation episode step 45 can occur in which controller 25 can deactivate circulation pump motor 13 and continue to operate drain pump motor 19 for a predetermined time to complete draining of tub 10. Those skilled in the art will appreciate that in step 45 controller 25 can allow circulation pump motor 13 to continue to operate for a predetermined period of time during the drain sub-cycle to facilitate the flushing of liquid, detergent and soil particles to drain while undergoing periodic liquid starvation episodes. Last, in step 46, at the next fill sub-cycle the adjusted amount of liquid can be added. While the method for adaptively adjusting the amount of liquid added in fill sub-cycles has been described referring to FIG. 1 and sensor circuit 50 in general, those skilled in the art will appreciate that the steps of the adaptive fill adjustment method illustrated in FIG. 2 can be practiced with any of the embodiments of a sensor and sensor circuit shown in FIG. 3 through FIG. 8. Configuration of controller 25 that can include a microprocessor running an algorithm, not shown, to perform method steps 36 to 46 is well known in the art and is obvious to those skilled in the art.

Figure 1A:
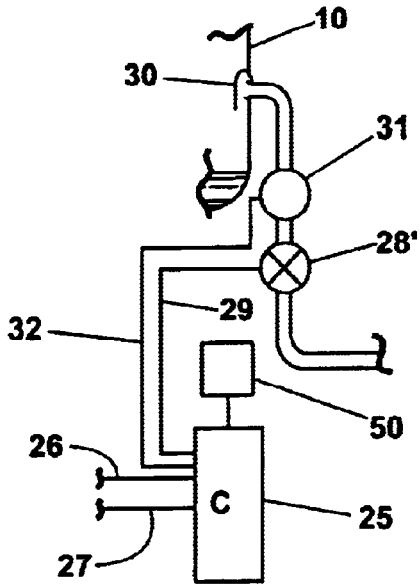
FIG. 1A is partial schematic another embodiment of the dishwasher of FIG. 1 with a flow meter for controlling the amount of liquid added to the dishwasher.

Referring FIG. 1A, another embodiment for controlling the amount of liquid added under control of the adaptive fill can be seen. In the embodiment of FIG. 1, the amount of liquid added in a fill sub-cycle can be controlled by controlling the amount of time that fill valve 28 having a flow control washer is energized by controller 25. In the embodiment of FIG. 1A, a flow meter 31 can be connected between fill valve 28' and tub inlet 30. Fill valve 28' can include a flow control washer. However, fill valve 28' need not include a flow control washer relying on flow meter 31 to meter liquid added in fill sub-cycles. Flow meter 31 can provide a series of pulses each representative of a known amount of liquid as liquid passes through flow meter 31. Pulses from flow meter 31 can be provided to controller 25 via flow meter line 32 as fill valve 28' is activated allowing liquid to flow through fill valve 28' and flow meter 31 as is well known in the art. Control 25 can control the amount of liquid added by counting the pulses from flow meter 31 and deactivating fill valve 28' when the adjusted amount of liquid has passed through fill valve 28' and flow meter 31.

Figure 3:
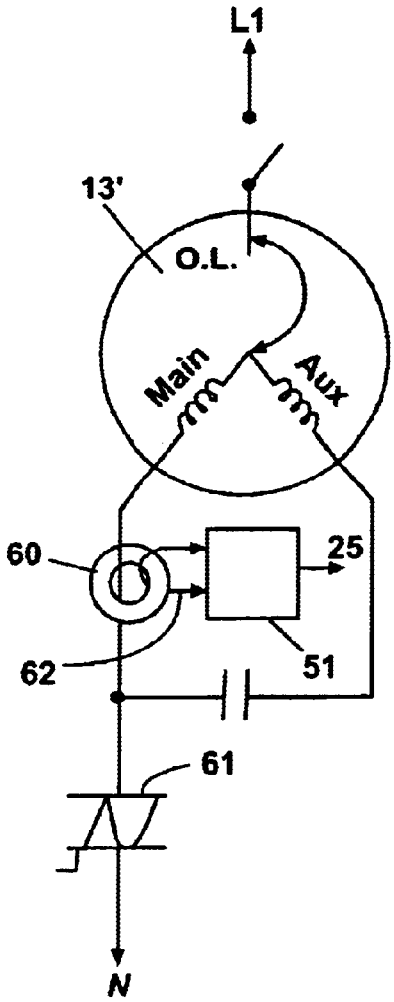
FIG. 3 is a partial schematic view of a ferrite sensor for sensing when the circulation pump experiences a liquid starvation episode.

Turning to FIG. 3, one embodiment of circulation pump motor 13' can be seen. Circulation pump motor 13' can be a PSC motor having main and auxiliary windings. The circulation pump motor 13' main winding can be connected to a triac 61 through a ferrite core 60 such as are available from Fair-Rite Products Corporation. A single turn sense winding 62 can pass through ferrite 60 and connect to a sensor circuit 51. Sense winding 62 and sensor circuit 51 can monitor the phase lag angle of the main winding of PSC circulation pump motor 13'. When circulation pump 12 is operating with sufficient liquid to prevent liquid starvation the phase lag angle of motor 13' can, for example, be sixty-two degrees. When controller 25 activates drain pump motor 19 to drain liquid from tub 10 the amount of liquid available to pump 12 decreases to the point that pump 12 experiences a liquid starvation episode. When circulation pump 12 experiences a liquid starvation episode pump 12 will speed up and the circulation pump motor 13' phase lag angle will increase well beyond normal operating phase lag of sixty-two degrees plus ten degrees, or to a phase lag in excess of seventy-two degrees in this example. Sensor circuit 51 can be arranged to provide a signal to controller 25 when the phase lag angle of the main winding of circulation pump motor 13' is in excess of seventy-two degrees in this example. A circuit for monitoring the main winding phase lag for a domestic appliance with a PSC motor is disclosed in my U.S. Pat. No. 4,481,786 incorporated herein by reference.

Figure 4:
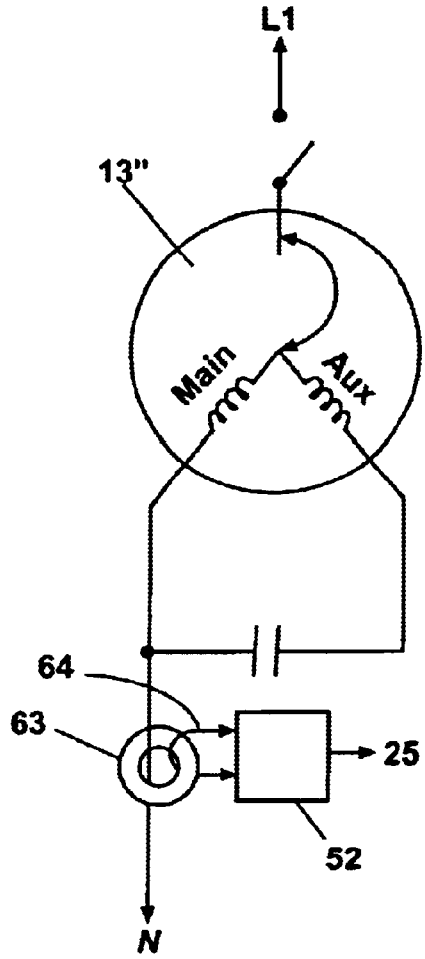
FIG. 4 is a partial schematic view of another embodiment of a ferrite sensor for sensing when the circulation pump experiences a liquid starvation episode.

Turning to FIG. 4, another embodiment of circulation pump motor 13" can be seen. In the embodiment of FIG. 4 a small saturating ferrite 63 can be provided surrounding the line connecting circulation pump motor 13" to N to sense the total current flowing through circulation pump motor 13". A sense winding 64 can be provided through ferrite 63 to provide a signal to sensor circuit 52 to monitor the total phase lag angle of circulation pump motor 13". When controller 25 activates drain pump motor 19 to drain liquid from tub 10 the amount of liquid available to pump 12 decreases to the point that pump 12 experiences a liquid starvation episode. When circulation pump 12 experiences a liquid starvation episode pump 12 will speed up and the phase lag angle can increase from about twenty degrees to forty degrees for example. Sensor circuit 52 can be arranged to provide a signal to controller 25 when the phase lag angle of the circulation pump motor 13" is in excess of twenty degrees plus six degrees, or twenty-six degrees in this example.

Figure 5:
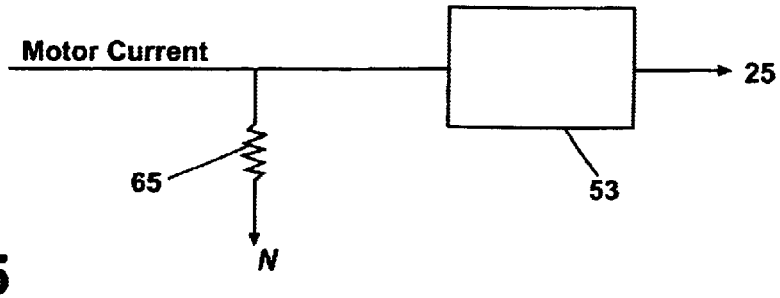
FIG. 5 is a partial schematic view of a current sensor for sensing when the circulation pump experiences a liquid starvation episode.

Turning to FIG. 5, another embodiment of sensor and sensor circuit can be seen. In the embodiment of FIG. 5 a small resistor 65 can be placed in series circuit with circulation pump motor 13 to provide a voltage to sensor circuit 53 proportionate to current flowing through circulation pump motor 13. The total current through circulation pump motor 13 will decrease when circulation pump 12 experiences a liquid starvation episode. Sensor circuit 53 can be arranged to provide a signal to controller 25 when the circulation pump motor current through resistor 65 falls to a predetermined level indicative of circulation pump 12 experiencing a liquid starvation episode. Those skilled in the art will recognize that a current transformer connected to track total current through circulation pump motor 13 can be used in place of resistor 65 as is well known in the art.

Figure 6:
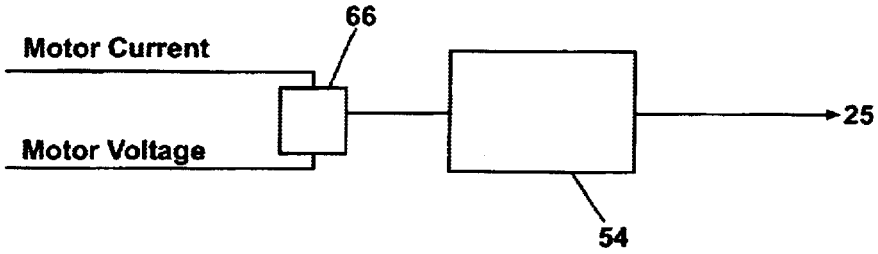
FIG. 6 is a partial schematic view of a power sensor for sensing when the circulation pump experiences a liquid starvation episode.

Turning to FIG. 6, another embodiment of sensor and sensor circuit can be seen. In the embodiment of FIG. 6 a power sensor 66 can be connected to circulation pump motor 13 to sense motor torque by sensing both motor voltage and current. Circulation pump motor torque, as indicated by wattage, will decrease when circulation pump 12 experiences a liquid starvation episode. Sensor 66 can be connected to sensor circuit 54 to provide a signal to controller 25 when the wattage detected by sensor 66 falls to a level indicative of a liquid starvation episode.

Figure 7:
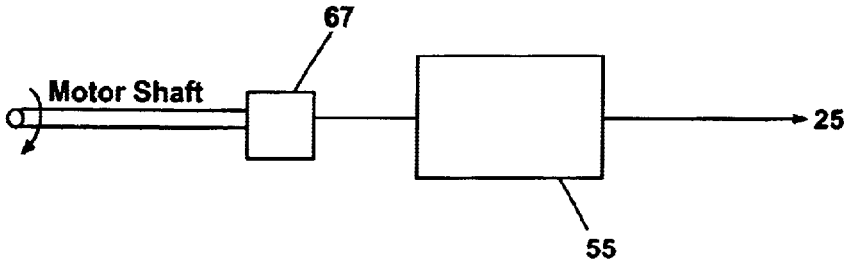
FIG. 7 is a partial schematic view of a speed sensor for sensing when the circulation pump experiences a liquid starvation episode.

Turning to FIG. 7, another embodiment of sensor and sensor circuit can be seen. In the embodiment of FIG. 7, a tachometer 67 can be connected to the motor shaft of circulation pump motor 13 and to sensor circuit 55 to provide a signal to sensor circuit 55 indicative of the speed of circulation pump motor 13. As with the case of other operating parameters discussed above, the speed of circulation pump motor 13 will increase when circulation pump 12 experiences a liquid starvation episode. Sensor circuit 55 can be arranged to provide a signal to controller 25 when tachometer detects a motor speed of circulation pump motor 13 indicative of pump 12 experiencing a liquid starvation episode.

Figure 8:
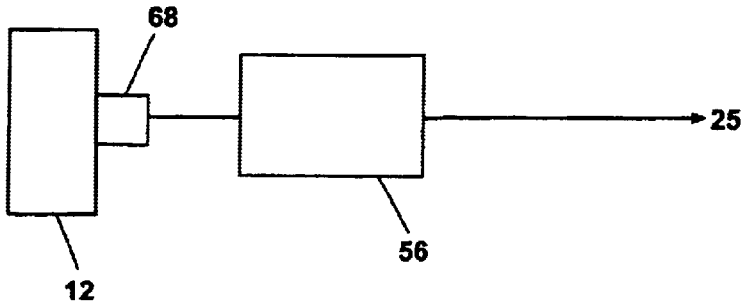
FIG. 8 is a partial schematic view of a pressure sensor for sensing when the circulation pump experiences a liquid starvation episode.

Turing to FIG. 8, another embodiment of sensor and sensor circuit can be seen. In the embodiment of FIG. 8, a pressure sensor 68 can be connected to circulation pump 12 to sense the liquid pressure generated by circulation pump 12. Pressure sensor 68 can be connected to sensor circuit 56 so that sensor circuit 56 can provide a signal to controller 25 when circulation pump 12 experiences a liquid starvation episode. When circulation pump 12 experiences a liquid starvation episode the pressure generated by circulation pump 12 will decrease. Pressure sensor 68 and sensor circuit can be arranged to provide a signal to controller 25 when circulation pump 12 experiences a liquid starvation episode.

In operation, controller 25 can initiate a selected dishwasher cycle upon command by a user. A dishwasher cycle can begin with a liquid fill sub-cycle. Those skilled in the art will recognize that a drain sub-cycle can precede an initial liquid fill sub-cycle to assure that excess liquid present in the dishwasher sump 11 is pumped to drain before commencing the selected cycle. Unless the dishwasher use is the first use as described below, controller 25 can apply the adjusted fill amount of liquid stored in the adaptive fill memory, not shown. Following the initial liquid fill sub-cycle controller 25 can initiate a wash or rinse sub-cycle in which the circulation pump 12 is operated by activation of circulation pump motor 13. Near the end of the wash or rinse sub-cycle controller 25 can initiate the adaptive fill adjustment method steps. The adaptive fill adjustment method steps can include activating drain pump motor 19 and thereby drain pump 16 while allowing circulation pump 12 to continue in operation. The microprocessor, not shown, in controller 25 can begin to accumulate time starting with activation of drain pump 16. As drain pump 16 withdraws liquid from sump 11 the amount of liquid remaining in dishwasher tub 10 will be reduced to the point that there will be insufficient liquid available for circulation pump 12 and a liquid starvation episode will occur. Typically in a liquid starvation episode circulation pump 12 will have little or no liquid available to pump so that a combination of air and water is drawn into circulation pump 12. Liquid circulating in tub 10 will fall to sump 11 and sufficient liquid may collect at the inlet to circulation pump 12 to allow circulation pump 12 to resume pumping liquid until another liquid starvation episode occurs.

A sensor and sensor circuit such as one of the embodiments of sensors and sensor circuits shown in FIG. 3 through FIG. 8 can monitor an operating parameter of circulation pump 12 or circulation pump motor 13. The microprocessor in controller 25 can compute the operating parameter at liquid starvation (step 40 in FIG. 2). Controller 25 continues to monitor output of sensor circuit 50 and compares the current signal to the computed value indicative of a liquid starvation episode (step 41 in FIG. 2). When circulation pump 12 experiences a liquid starvation episode the signal from the sensor circuit 50 to the microprocessor, not shown, in controller 25 causes a "NO" result in step 41 in FIG. 2. The "NO" result in step 41 (FIG. 2) ends the accumulation of time for a liquid starvation episode to occur. The microprocessor in controller 25 can then compare the accumulated time for a liquid starvation episode with a predetermined factory set optimum time for a liquid starvation episode to occur (step 42 in FIG. 2). If the accumulated time is greater than the predetermined time the microprocessor can decrease the amount of liquid added in the next fill sub-cycle based on the most recent fill sub-cycle amount of liquid (step 43 in FIG. 2). Conversely, if the accumulated time is less than the predetermined time the microprocessor can increase the amount of liquid added in the next fill sub-cycle based on the most recent fill sub-cycle amount of liquid (step 44 in FIG. 2). The adaptive fill adjusted amount of liquid can be stored in the adaptive fill memory, not shown, for the next fill sub-cycle.

When a liquid starvation episode occurs controller 25 can de-activate circulation pump 12 by de-activating circulation pump motor 13 while drain pump 16 continues to operate for a predetermined drain sub-cycle (step 45 in FIG. 2). At completion of the drain sub-cycle a fill sub-cycle can occur. In the following fill sub-cycle controller 25 causes the adaptive fill adjusted amount of liquid stored in the adaptive fill memory to be added to the dishwasher (step 46 in FIG. 2). In operation, the adaptive fill adjustment method steps can be used near the end of each wash or rinse circulation sub-cycle by controller 25. Alternately, the adaptive fill adjustment method steps can be used on less than all wash or rinse circulation sub-cycles, or even on a single circulation sub-cycle. An advantage of using the adaptive fill adjustment method steps near the end of multiple circulation sub-cycles is that in the event of a cup or glass flipping over during a circulation sub-cycle and retaining liquid, the subsequent fill sub-cycle can be adjusted to compensate for the liquid held in the flipped over item. The adaptive fill control can use the most recent previous liquid fill amount to adjust the fill amount for the next fill sub-cycle. Use of the most recent liquid fill amount allows the adaptive fill control to converge the fill amount to an optimum amount of liquid.

The adaptive fill adjustment method can allow a dishwasher to adjust the amount of liquid added in fill sub-cycles to adapt to variables typically experienced in dishwasher cycles, namely small or large loads, light or heavy or protein soil load on dishes being washed, retention of liquid by one or more dishes (such as a flipped cup or glass) during a circulation sub-cycle as mentioned above, rinse aid material or carryover rinse aid material from a prior sub-cycle, presence of hand wash detergent rather than or in addition to dishwasher detergent, or aeration due to detergent sudsing during a prolonged thermal hold period. Similarly, the adaptive fill adjustment method can allow a dishwasher to adapt to utility variations including water pressure and line voltage variations that can lead to overfilling in conventional dishwashers that typically provide sufficient liquid fill under worst case conditions.

Any of the variables described in the previous paragraph can cause a liquid starvation episode due to sequestration of liquid by the dish load, aeration or surfactant action. A liquid starvation episode resulting from variables described in the previous paragraph can occur early in a liquid circulation sub-cycle. It will be appreciated by those skilled in the art that sequestration of liquid by a flipped glass or cup can occur at any time, not only at the beginning of a circulation sub-cycle. Controller 25 can include a microprocessor, not shown, running an algorithm to perform the method steps shown in FIG. 2. The algorithm can also include steps to detect circulation pump liquid starvation episodes at times in circulation sub-cycles other than near the end of the circulation sub-cycles when the adaptive fill adjustment occurs. For example, sensor circuit 50 could monitor circulation pump 12 and/or circulation pump motor 13 operating parameters over the circulation sub-cycle by monitoring the maximum and minimum value of the operating parameters over periods sufficiently long for a liquid starvation episode to occur. Controller 25 could infer a liquid starvation episode when the difference between the maximum and minimum values exceeds a predetermined threshold. Controller 25 could be programmed to take action in response to such a liquid starvation episode depending on when the liquid starvation episode occurred in a sub-cycle or the dishwasher cycle. For example, a liquid starvation episode near the beginning of the first liquid circulation sub-cycle could infer protein soil, carryover rinse-aid material, or the presence of hand wash detergent. Possible actions in response to a liquid starvation episode near the beginning of the first circulation sub-cycle can include one or more of adding additional liquid to quell the liquid starvation episodes, shorten the duration of the current circulation sub-cycle, suspend the adaptive fill adjustment and institute a predetermined liquid fill for the next fill sub-cycle and add one or more additional fill, circulation and drain sequences to the dishwasher cycle to purge material such as hand washing detergent causing liquid starvation episodes, particularly if such episodes recur after the addition of liquid to quell such episodes. Sudden recurring starvation episodes during a circulation sub-cycle when a thermal hold is not occurring can infer a flipped cup or glass. Possible actions in response to a flipped cup or glass can include adding additional liquid and suspending the adaptive fill adjustment for the remainder of the dishwasher cycle. Sudden recurring starvation episodes during a circulation sub-cycle when a thermal hold is occurring can infer aeration due to detergent sudsing during the prolonged thermal hold period. Possible actions in response to liquid starvation episodes during a thermal hold can include aborting the current circulation sub-cycle and suspending the adaptive fill adjustment for the next fill sub-cycle and use the previous base liquid amount for the next fill sub-cycle. A liquid starvation episode during a rinse circulation sub-cycle following addition of rinse-aid material can infer addition of rinse-aid material. In response to a liquid starvation episode in a rinse circulation sub-cycle can be addition of liquid to quell the liquid starvation episodes. In addition, occurrence of a liquid starvation episode in a rinse circulation sub-cycle can trigger addition of an additional liquid amount in the first fill sub-cycle of the next dishwasher cycle to overcome any rinse-aid material carryover.

Controller 25 can include a preprogrammed fill period to add a sufficient amount of liquid to allow circulation pump 12 to achieve maximum circulation pump spray force under any operating conditions, including worst case conditions. Controller 25 can be arranged to utilize the preprogrammed fill period for the first fill sub-cycle the first time the dishwasher is used. The preprogrammed fill period can thereby provide the base liquid fill amount for adaptive adjustment over subsequent fill sub-cycles as set forth above. Controller 25 can also include fill cycle high and low limits to assure that a certain minimum amount of liquid, and no more than a maximum of amount of liquid is added in any fill sub-cycle. The adaptive fill memory in controller 25 can include non-volatile memory to store the most recent adjusted fill amount of liquid. Use of a non-volatile memory to store the adjusted fill amount can allow controller 25 to continue the adaptive fill adjustment iterative method over multiple dishwasher cycles whether or not power has been continuously maintained to the dishwasher. Those skilled in the art will understand that the adaptive fill memory can be included in the microprocessor, not shown, in controller 25, or can be a separate memory device included in controller 25.

Controller 25 can be arranged to provide for predetermined fixed small additions to the adjusted fill amount of liquid stored in the adaptive fill memory, not shown. One application for a fixed small amount of liquid to be added in a fill sub-cycle in addition to the stored adjusted fill amount can be for the first fill sub-cycle in a dishwasher cycle. The addition of a fixed additional small amount of liquid can assure adequate liquid for the circulation pump to achieve maximum circulation pump spray force notwithstanding that the current dishwasher cycle may be operating with a load of dishes that requires more liquid than the preceding cycle on which the adjusted fill amount of liquid was based. Another application for a fixed small amount of liquid to be added can be for the first fill sub-cycle in a dishwasher cycle following several days of not using the dishwasher. After several days without use some or all of the liquid normally remaining in the sump 11 of the dishwasher after a cycle can evaporate. The addition of a fixed small amount of liquid can compensate for any such liquid evaporation. Another application for a fixed small amount of liquid to be added can be for the first fill sub-cycle of a dishwasher cycle subsequent to a dishwasher cycle that included a HEAT DRY sub-cycle. A HEAT DRY sub-cycle can evaporate some of the liquid normally remaining in the sump 11 of a dishwasher at the end of a cycle. The addition of a fixed small amount of liquid can compensate for any such evaporation and assure a sufficient amount of liquid for maximum circulation pump spray force in the first liquid circulation sub-cycle in the next dishwasher cycle. The fixed small amounts of liquid described above can be the same amount in each case, or as will be obvious to those skilled in the art, can be different amounts to adjust for the respective anticipated conditions. The fixed small amount of liquid for the first fill sub-cycle of a new dishwasher cycle can be an additional 5 seconds of fill time when the fill amount is determined by the time the fill valve is activated. A similar adjustment can be made when a flow meter is used to measure the adjusted amount of liquid added in a fill sub-cycle The adaptive fill control can sense a failure of the dishwasher to drain liquid from sump 11. When drain pump 16 is activated near the end of a circulation sub-cycle sensor circuit 50 provides a signal to controller 25 when circulation pump 12 experiences a liquid starvation episode. If drain pump 16 fails to pump liquid to drain for whatever reason such as a blocked drain, sensor circuit 50 will not provide a liquid starvation episode signal to controller 25 since circulation pump 12 continues to receive adequate liquid. After a predetermined time period the microprocessor, not shown, in controller 25 can shut down the dishwasher and set a blocked drain signal to advise the operator to check the drain. The blocked drain signal can be an indicator light or a LCD display panel of the face of the dishwasher, not shown, as will be readily understood by those skilled in the art.

The adaptive fill control can sense when a rinse-aid dispenser typically provided in dishwashers, not shown, is empty. As described above, presence of rinse-aid material in a circulation sub-cycle can cause a liquid starvation episode due to the action of the surfactant in the rinse-aid material. This can be especially true when the available amount of liquid has been controlled by the adaptive fill control according to the invention. Whether or not a liquid starvation episode occurs, presence of rinse-aid material can be confirmed by monitoring operating parameters of circulation pump 12 and/or circulation pump motor 13. Presence of rinse-aid material in normal concentrations can be detected by a decrease in circulation pump pressure, an increase in circulation pump motor speed, a decrease in circulation pump motor torque, a decrease in circulation pump motor current, an increase in circulation pump motor main winding phase lag, or an increase in circulation pump motor total phase lag, each as compared to when rinse-aid material is not present in the dishwasher liquid. Controller 25 can be arranged to provide a "fill rinse-aid dispenser" signal in response to failure to detect the presence of rinse-aid material in a rinse circulation sub-cycle following activation of the rinse-aid dispenser, not shown, to advise the dishwasher user that the rinse-aid material dispenser is empty. Controller 25 can also be arranged to attempt another addition of rinse-aid material in the event controller 25 and sensor circuit 50 fails to detect presence of rinse-aid material. Those skilled in the art will recognize that controller 25 can be arranged to both attempt another addition or rinse-aid material, and if no rinse-aid material is detected, provide a "fill rinse-aid dispenser" signal. As described above, when the presence of rinse-aid material is detected and a liquid starvation episode occurs, controller 25 can cause an addition of liquid to quell the liquid starvation episodes.

The following Tables demonstrate the performance of an adaptive fill control applied to a dishwasher. Table I presents results of a series of fill sub-cycles in a dishwasher loaded with 10 place settings of dishes. Table II presents results of a series of fill sub-cycles with an empty dishwasher, then a series of fill sub-cycles with 10 place settings of dishes in the dishwasher. In both Table I and Table II the controller was reset to perform the first fill sub-cycle as a "first use" with a predetermined fill of 90 seconds. In the case of Table 11 the controller was not reset between the "no dishes" fill sub-cycles and the 10 place settings fill sub-cycles to demonstrate the response of the adaptive fill control to successive dishwasher cycles where the adjusted fill amount is stored in the microprocessor non-volatile memory from one cycle to the next.

TABLE I

| Fill Time in Seconds | Accumulated Time to Liquid Starvation in AC Half Cycles | Next Fill Time in Seconds | Hot Water Savings |
|---|---|---|---|
| | (10 place settings) | | |
| 90 (predetermined) | 1476 | 83 | 10% |
| 83 | 1018 | 80 | 17% |
| 80 | 878 | 78 | 20% |
| 78 | 674 | 79 | 22% |
| 79 | 798 | 78 | 21% |
| 78 | 726 | 77 | 22% |
| 77 | 595 | 78 | 23% |
| 78 | 736 | 77 | 22% |

TABLE II

| Fill Time in Seconds | Accumulated Time to Liquid Starvation in AC Half Cycles | Next Fill Time in Seconds | Hot Water Savings |
|---|---|---|---|
| | (no dishes) | | |
| 90 (predetermined) | 1867 | 80 | 10% |
| 80 | 1142 | 76 | 20% |
| 76 | 824 | 74 | 24% |
| 74 | 754 | 73 | 26% |
| 73 | 693 | 74 | 27% |
| 74 | 736 | 73 | 26% |
| 73 | 638 | 74 | 27% |
| 74 | 681 | 75 | 25% |
| 75 | 772 | 74 | 25% |

TABLE II-continued

| Fill Time in Seconds | Accumulated Time to Liquid Starvation in AC Half Cycles | Next Fill Time in Seconds | Hot Water Savings |
|---|---|---|---|
| | (10 place settings) | | |
| 74 | 95 | 76 | 26% |
| 76 | 633 | 77 | 24% |
| 77 | 697 | 78 | 23% |
| 78 | 763 | 77 | 22% |

The results shown in Table I and Table II demonstrate that the adaptive fill control rapidly converges on an optimum fill amount of liquid, and responds quickly from cycle to cycle when significantly different loads are present in the dishwasher. Further, the adaptive fill control can provide significant energy savings through reduced use of hot water normally used in the United States to fill household dishwashers.

While the invention has been specifically described in connection with certain specific embodiments thereof, it is to be understood that this is by way of illustration and not of limitation, and the scope of the appended claims should be construed as broadly as the prior art will permit.

We claim:

1. A method for adjusting the amount of liquid added to a dishwasher in one or more liquid fill periods in a dishwasher cycle comprising:

activating the dishwasher drain pump to drain liquid from the dishwasher while continuing to operate the dishwasher circulation pump prior to the end of at least one liquid circulation period;

accumulating the time from the start of the drain pump operation until the circulation pump experiences a liquid starvation episode;

comparing the accumulated time period with a predetermined optimum time period for the circulation pump to experience liquid starvation;

using the difference between the accumulated time period and the predetermined optimum time period to adjust the amount of liquid added in the next liquid fill period; and adding the adjusted amount of liquid during the next liquid fill period.

2. The method for adjusting the amount of liquid added to a dishwasher according to claim 1, wherein the dishwasher has a controller including an adaptive fill memory and the amount of liquid added in liquid fill periods is adjusted in more than one liquid fill period, the method further comprising storing the adjusted amount of liquid in the adaptive fill memory and using the stored adjusted amount of liquid as the basis to increase or decrease the adjusted amount of liquid for the next liquid fill period.

3. The method for adjusting the amount of liquid added to a dishwasher according to claim 1, wherein the circulation pump is deactivated after the circulation pump experiences a liquid starvation episode, and the drain pump is operated for an additional predetermined drain period after the circulation pump is deactivated to complete draining of liquid at the end of the liquid circulation period.

4. The method for adjusting the amount of liquid added to a dishwasher according to claim 1, wherein the circulation pump liquid starvation episode is detected by monitoring an operational condition of the circulation pump.

5. The method for adjusting the amount of liquid added to a dishwasher according to claim 1, wherein the dishwasher has a controller including fill cycle high and low limits to assure that the adjusted amount of liquid is greater than a minimum and less than a maximum amount of liquid.

6. The method for adjusting the amount of liquid added to a dishwasher according to claim 1, wherein the dishwasher has a controller and wherein absence of a circulation pump liquid starvation episode within a predetermined time following activation of the drain pump infers a drain failure condition and causes the controller to provide a drain failure indication and stop the dishwasher cycle.

7. The method for adjusting the amount of liquid added to a dishwasher according to claim 1, wherein the dishwasher has a controller and occurrence of a circulation pump liquid starvation episode prior to activating the dishwasher drain pump causes the controller to infer an abnormal operating condition variable and causes the controller to take one or more actions selected from the group of: adding liquid to quell the liquid starvation episodes, shorten the current circulation sub-cycle, institute a predetermined liquid fill for the next fill sub-cycle, and add one or more additional fill, circulation and drain sub-cycle sequences to the dishwasher cycle.

8. The method for adjusting the amount of liquid added to a dishwasher according to claim 1, wherein said method includes monitoring the circulation pump following addition of rinse-aid material to confirm the presence of rinse-aid material by detecting a change in an operational condition of the circulation pump compared to the operational conditions of the circulation pump prior to the addition of the rinse-aid material.

9. The method for adjusting the amount of liquid added to a dishwasher according to claim 2, wherein the liquid fill periods have a duration and the adjusted amount of liquid added in a liquid fill period is increased or decreased by adjusting the duration of the liquid fill period.

10. The method for adjusting the amount of liquid added to a dishwasher according to claim 2, wherein the adjusted amount of liquid added in a liquid fill period is increased or decreased by controlling the amount of liquid added using a liquid flow meter.

11. The method for adjusting the amount of liquid added to a dishwasher according to claim 2, wherein the amount of liquid added in the first liquid fill period following an interruption of power to the dishwasher is predetermined to provide sufficient liquid for the circulation pump to operate without experiencing liquid starvation prior to activation of the drain pump under any operating conditions.

12. The method for adjusting the amount of liquid added to a dishwasher according to claim 2, wherein the adaptive fill memory is non-volatile and the adjusted amount of liquid is stored in the non-volatile adaptive fill memory, and wherein the controller uses the stored adjusted amount of liquid for the first liquid fill period following an interruption of power to the dishwasher.

13. The method for adjusting the amount of liquid added to a dishwasher according to claim 2, wherein the amount of liquid added in each liquid fill period in the dishwasher cycle is adjusted.

14. The method for adjusting the amount of liquid added to a dishwasher according to claim 2, wherein an additional small amount of liquid is added to the adjusted amount of liquid stored in the adaptive fill memory for the first liquid fill period of a new dishwasher cycle to compensate for evaporation of residual wash liquid in the dishwasher between dishwasher cycles.

15. The method for adjusting the amount of liquid added to a dishwasher according to claim 2, wherein an additional small amount of liquid is added to the adjusted amount of liquid stored in the adaptive fill memory for the first liquid fill period of a new dishwasher cycle to compensate for evaporation of residual wash liquid when the previous dishwasher cycle included a heated drying period.

16. The method for adjusting the amount of liquid added to a dishwasher according to claim 4, wherein the circulation pump liquid starvation episode is detected by a sudden circulation pump pressure decrease.

17. The method for adjusting the amount of liquid added to a dishwasher according to claim 4, wherein the circulation pump liquid starvation episode is detected by a sudden circulation pump speed increase.

18. The method for adjusting the amount of liquid added to a dishwasher according to claim 4, wherein the circulation pump liquid starvation episode is detected by a sudden circulation pump motor torque decrease.

19. The method for adjusting the amount of liquid added to a dishwasher according to claim 4, wherein the circulation pump liquid starvation episode is detected by a sudden circulation pump motor current decrease.

20. The method for adjusting the amount of liquid added to a dishwasher according to claim 4, wherein the circulation pump liquid starvation episode is detected by a sudden circulation pump motor main winding phase lag increase.

21. The method for adjusting the amount of liquid added to a dishwasher according to claim 4, wherein the circulation pump liquid starvation episode is detected by a sudden circulation pump motor phase lag increase.

22. The method for adjusting the amount of liquid added to a dishwasher according to claim 8, wherein the dishwasher has a controller and wherein failure to detect presence of rinse-aid material causes the controller to take one or more actions selected from the group of causing the controller to attempt another addition of rinse-aid material and providing a fill rinse-aid dispenser signal.

23. The method for adjusting the amount of liquid added to a dishwasher according to claim 14, wherein a greater additional amount of liquid is added to the adjusted amount of liquid stored in the adaptive fill memory for the first liquid fill period of a new dishwasher cycle after the dishwasher has not been operated for several days.

24. A method for adjusting the amount of liquid added to a dishwasher in one or more liquid fill periods in one or more dishwasher cycles each including a plurality of liquid fill periods, a plurality of liquid circulation periods and a plurality of liquid drain periods operated by a controller comprising:

activate the dishwasher drain pump to drain liquid from the dishwasher while continuing to operate the dishwasher circulation pump near the end of at least one liquid circulation period;

monitor operation of the circulation pump to accumulate a circulation pump starvation period beginning with activation of the drain pump and ending when the circulation pump experiences a liquid starvation episode;

compare the circulation pump starvation period with a predetermined optimum time period for the circulation pump to experience liquid starvation to decrease or increase the amount of liquid added stored in the controller depending on whether the circulation pump starvation period is longer or shorter than the predetermined optimum time period to determine an adjusted amount of liquid;

deactivate the circulation pump after the circulation pump experiences a liquid starvation episode and continue to operate the drain pump to complete draining of the liquid at the end of the liquid circulation period;

store the adjusted amount of liquid in the controller for the next liquid fill period replacing the amount of liquid; and add the adjusted amount of liquid in the next liquid fill period of the dishwasher.

25. The method for adjusting the amount of liquid added to a dishwasher according to claim 24, wherein the circulation pump liquid starvation episode is detected by monitoring a circulation pump operating parameter selected from the group consisting of detecting: a sudden decrease in circulation pump pressure, a sudden increase in circulation pump motor speed, a sudden decrease in circulation pump motor torque, a sudden decrease in circulation pump motor current, a sudden increase in circulation pump motor main winding phase lag, or a sudden increase in circulation pump motor total phase lag.

26. The method for adjusting the amount of liquid added to a dishwasher according to claim 24, wherein each liquid fill period in each of the dishwasher cycles is adjusted.

27. The method for adjusting the amount of liquid added to a dishwasher according to claim 24, wherein the circulation pump is allowed to continue to operate for a preset time after detection of the liquid starvation episode.

* * * * *